United States Patent [19]

Takahashi et al.

[11] 4,360,383

[45] * Nov. 23, 1982

[54] ABRASION RESISTANT SINTERED ALLOY FOR INTERNAL COMBUSTION ENGINES

[75] Inventors: Kentaro Takahashi; Yoshikatsu Nakamura, both of Omiya; Masajiro Takeshita, Yono, all of Japan

[73] Assignee: Nippon Piston Ring Co., Ltd., Tokyo, Japan

[ * ] Notice: The portion of the term of this patent subsequent to Aug. 24, 1999, has been disclaimed.

[21] Appl. No.: 144,114

[22] Filed: Apr. 28, 1980

[30] Foreign Application Priority Data

Apr. 26, 1979 [JP] Japan ..... 54-50931

[51] Int. Cl.[3] ..... B22F 3/10

[52] U.S. Cl. ..... 75/236; 75/246; 75/203; 75/239; 428/550

[58] Field of Search ..... 75/203, 204, 123 D, 75/123 J, 126 F, 126 K, 239, 246, 236; 428/550

[56] References Cited

U.S. PATENT DOCUMENTS

| | | | |
|---|---|---|---|
| 3,250,612 | 5/1966 | Roy | 75/126 F |
| 3,698,877 | 10/1972 | Motoyoshi | 75/211 |
| 3,767,386 | 10/1973 | Veda | 75/126 K |
| 3,890,105 | 6/1975 | Weissmann | 75/203 |
| 3,977,838 | 8/1976 | Hashimoto | 75/204 |
| 4,000,980 | 1/1977 | Morishita | 75/204 |
| 4,021,205 | 5/1977 | Matsuda | 75/126 F |
| 4,036,640 | 7/1977 | Philip | 75/126 F |

FOREIGN PATENT DOCUMENTS

| | | |
|---|---|---|
| 2508798 | 4/1975 | Fed. Rep. of Germany . |
| 241689 | 10/1967 | U.S.S.R. . |

*Primary Examiner*—M. J. Andrews
*Assistant Examiner*—J. J. Zimmerman
*Attorney, Agent, or Firm*—Sughrue, Mion, Zinn, Macpeak & Seas

[57] ABSTRACT

An abrasion resistant sintered alloy for use in internal combustion engines which comprises 0.5 to 4.0% by weight of carbon, 5.0 to 30.0% by weight of Cr, 1.5 to 16.0% by weight of Nb, 0.1 to 4.0% by weight of Mo, 0.1 to 10.0% by weight of Ni and 0.1 to 5.0% by weight of P, which permits liquid-phase sintering at temperatures not higher than 1,250° C., and have 0.2 to 10% by volume of sintering pores at least 40% of which consist of pores having a pore size of not larger than 150 μm, is disclosed.

4 Claims, 2 Drawing Figures

ABRASION RESISTANT SINTERED ALLOY FOR INTERNAL COMBUSTION ENGINES

BACKGROUND OF THE INVENTION

1. Field of the Invention

The present invention relates to an abrasion resistant sintered alloy for internal combustion engines, more specifically to sintered alloy for use in a slidable member for rocker arms, valve seats, piston rings, cylinder liners and the like.

2. Description of the Prior Art

Sintered alloy compositions exhibiting good abrasion resistance when in use as a slidable member at high planar pressures have been described in U.S. patent application Ser. No. 955,455 now U.S. Pat. No. 4,243,414 corresponding to German patent application (OLS) No. 2,846,122. This type of sintered alloy compositions are also described in U.S. Pat. Nos. 3,674,472, 2,637,671 and 3,698,877. Sintered alloy compositions which have further improved substrate structure and are superior particularly in pitting properties as compared with the conventional sintered alloy have been desired.

SUMMARY OF THE INVENTION

A primary object of the present invention is to provide an abrasion resistant sintered alloy composition (hereafter referred to as "sintered alloy composition") for internal combustion engines which exhibits excellent abrasion resistance when in use as a slidable member such as a rocker arm or the liner thereof used under severe conditions or as a member subjected to pitting wear such as a valve seat, etc.

As a result of extensive research made with reference to the test results, information, etc., of the sintered alloy compositions previously developed is achieved the present invention which provides a sintered alloy composition for internal combustion engines characterized by an alloy composition comprising 0.5 to 4.0% by weight of carbon, 5.0 to 30.0% by weight of chromium, 1.5 to 16.0% by weight of niobium, 0.1 to 4.0% by weight of molybdenum, 0.1 to 10.0% by weight of nickel and 0.1 to 5.0% by weight of phosphorus which permits sintering at temperatures not higher than 1,250° C., and the balance iron, having 0.2 to 10% by volume of sintering pores at least 40% of which consists of pores having a pore size of not more than 150 μm.

DETAILED DESCRIPTION OF THE INVENTION

Description of the Preferred Embodiment

Figure 1:
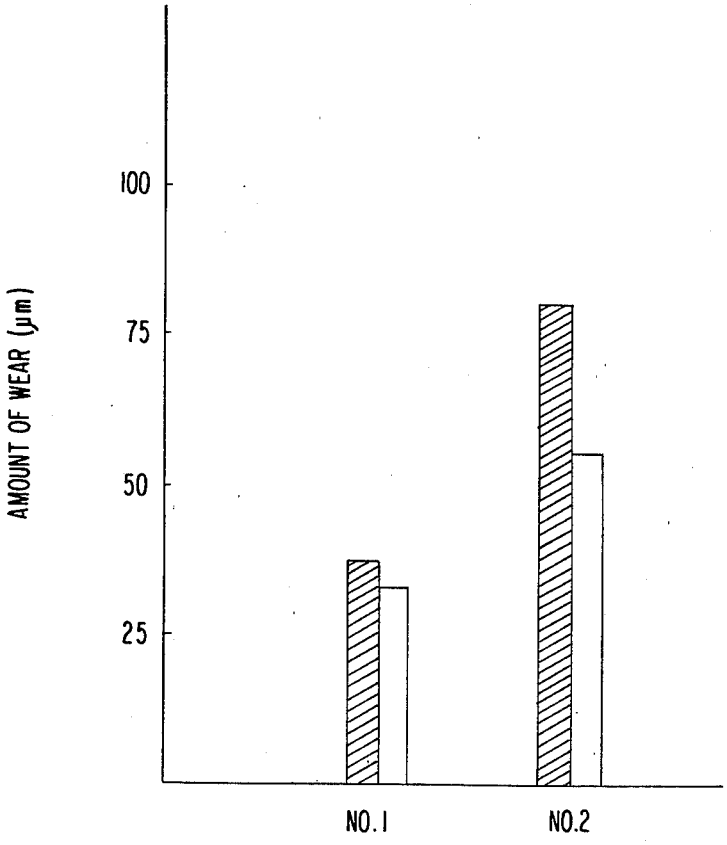
FIG. 1 is a graph showing the amounts of wear in an engine test of a rocker arm produced from the abrasion resistant sintered alloy in accordance with this invention.

In a preferred embodiment the abrasion resistant alloy of the present invention comprises 0.5 to 4.0% by weight of C, 5.0 to 20.0% by weight of Cr, 3.0 to 12.0% by weight of Nb, 0.4 to 3.0% by weight of Mo, 0.1 to 5.0% by weight of Ni and 0.2 to 3.0% by weight of P which permits liquid-phase sintering at temperatures not higher than 1,250° C. and the balance iron, having 0.2 to 10% by volume of sintering pores at least 40% of which consists of pores having a pore size of not more than 150 μm.

The activity of the various individual components of the sintered alloy composition of the present invention and the reasons for limiting their amounts are explained below.

Carbon is necessary for strengthening the substrate and forming a precipitation hardened (Fe containing chromium carbide) phase to impart abrasion resistance to the sintered alloy composition. The reason for limiting the amount of carbon as an alloy component is as follows. If the amount of carbon is less than 0.5% by weight, the amount of the precipitation hardened phase is inadequate, and abrasion resistance sufficient for the abrasion resistant members of internal combustion engines is not obtained. Furthermore, a high strength substrate is not obtained. On the other hand, if the amount of the precipitation hardened phase exceeds 4.0% by weight, the degree of brittleness of material increases to such an extent that it is no more useful. Therefore, the amount of carbon in the sintered alloy composition of the present invention need be set within the range of 0.5 to 4.0% by weight.

Slidable component parts used at high planar pressures tend to undergo pitting. Pitting is a fatigued phenomenon caused by repeated loads during sliding. Slidable members made of sintered alloy obtained by usual solid-phase sintering have many pores and therefore have low strength. Hence, such slidable members undergo pitting wear under repeated loads.

It is found that pitting resistance can advantageously be increased by subjecting a slidable member of sintered alloy to be used at high planar pressures to liquid-phase sintering. Conventionally, the liquid-phase sintering is performed at higher temperatures. However, in view of the durability of the sintering furnace, it is necessary to generate a sufficient liquid-phase amount at temperatures not more than 1,250° C. Phosphorus is effective because it is an element which permits liquid-phase sintering at not more than 1,250° C. without rendering the substrate structure brittle. When the amount of phosphorus is less than 0.1%, the amount of liquid-phase is too small and increase in strength cannot be obtained. On the other hand, when the amount of phosphorus is greater than 5.0%, the amount of liquid-phase becomes too large and a sintered body having a high dimensional accuracy cannot be obtained. For this reason phosphorus is used in an amount of 0.1 to 5.0% by weight. The amount of phosphorus added is inversely proportional to the sintering temperature.

Chromium is important for strengthening the substrate and combining with carbon to form the precipitation hardened phase as explained. When the amount of chromium is less than 5% by weight, the amount of the precipitation hardened phase is inadequate. On the other hand, when the amount of chromium exceeds 30% by weight, no marked increase in abrasion resistance is noted, and the increased amount of chromium only increases the price of the member. Furthermore, the resulting alloy has reduced machineability.

Niobium is added in order to precipitate fine particles of carbide thereof in the substrate structure to improve abrasion resistance. When it is used in an amount of less than 1.5% by weight the amount of the carbide obtained is so small that no satisfactory abrasion resistance can be obtained. On the other hand, it is not desirable to use Nb in an amount of more than 16% by weight since precipitation of the carbide thereof is to such an extent that the member made of the resulting composition abrades a counterpart member with which it is in a slidable contact.

Regarding the porosity, if the porosity exceeds 10% by volume, sintering is insufficient and the bond strength amongst the particles is weak. Thus, the resulting alloy is susceptible to fatigue and tends to induce pitting wear. Furthermore, its mechanical strength is degraded. Accordingly, porosity is limited to not more than 10% by volume. If it is less than 0.2% by volume, there are too few oil pools, the product has poor retention and is susceptible to scuff wear. The importance of pores is evident from the fact that a solution of the same components cannot give expected properties.

Desirably, the pores are fine and are dispersed uniformly. When the pore size is more than 150 μm and the porosity is less than 10% by volume, the pores are not uniformly present and the oil retention of the product is very poor. Accordingly, for the same reason, scuff wear tends to occur if fine pores having a size of not more than 150 μm are present in an amount of less than 40%.

Mo and Ni are added in order to further strengthen the substrate structure. The amount of Mo is selected to be 0.1 to 4.0% by weight since the addition of Mo in an amount of more than 4.0% by weight is disadvantageous from economic viewpoints, while it fails to strengthen the substrate structure in an amount of less than 0.1% by weight. Further, Ni which is added for strengthening the substrate structure causes the substrate structure to become brittle in an amount of 10.0% by weight but is ineffective for obtaining the desired property in an amount of less than 0.1% by weight.

For the foregoing reason, the sintered alloy material of the present invention should comprise 0.5 to 4.0% by weight of C, 5.0 to 30.0% by weight of Cr, 1.5 to 16.0% by weight of Nb, 0.1 to 4.0% by weight of Mo, 0.1 to 10.0% by weight of Ni and 0.1 to 0.5% by weight of P which permits liquid-phase sintering at temperatures not higher than 1,250° C., and the balance iron and have 0.2 to 10% by volume of sintering pores at least 40% of which consist of pores having a pore size of not larger than 150 μm.

Preferably, the abrasion resistant sintered alloy of the present invention contains 0.5 to 4.0% by weight of C, 5.0 to 20.0% by weight of Cr, 3.0 to 12.0% by weight of Nb, 0.4 to 3.0% by weight of Mo, 0.1 to 5.0% by weight of Ni and 0.2 to 3.0% by weight of P for the reason described above.

Further, the starting powders to be liquid sintered contain Si and Mn. The amount of Si and Mn should be limited to not more than 1.5% by weight and not more than 1.0% by weight, respectively, lest they should render the substrate structure brittle.

In the present invention, Ti and/or V can also be added as a carbide-forming element in addition to Nb for further improving abrasion resistance. In this case, the amount of Ti and/or V is preferably 0.1 to 10.0% by weight in total since the amount of precipitated carbide(s) becomes so large that the member made of the resulting composition abrades a counterpart member greatly when the amount is more than 10.0% by weight but the improvement of the abrasion resistance is unsatisfactory when the element(s) is or are contained in an amount of less than 0.1% by weight.

Cu and/or Co can also be added for strengthening the substrate structure if desired or necessary. Generally, the amount of Cu and/or Co depends on the amount of Ni added but is preferably 0.1 to 5.0% by weight. When it is more than 5.0% by weight the substrate becomes brittle, on the other hand, when it is less than 0.1% by weight satisfactory strengthening effect cannot be obtained.

After sintering, the product of the present invention is mainly perlite. The substrate structure can be strengthened in manners known in the art, if desired or necessary, depending upon the counterpart slidable members with which it is used. The substrate structure can be strengthened by heat-treating the composition after sintering to convert it mainly to a bainitic or martensitic structure. In this case, the pitting resistance of the product increases further. For example, when the product is heated at 870° C. after sintering and heat-treated in a salt bath at about 400° C. for about 10 to 40 hours, the substrate structure becomes bainitic. When it is heated at 870° C. and then heat-treated with water or oil at room temperature, the substrate structure becomes martensitic.

As described hereinbefore, the sintered alloy for internal combustion engines of the present invention contains relatively large and fine precipitations of Cr containing carbide and fine precipitation of Nb containing carbide in the substrate structure and exhibits excellent abrasion resistance. Further, the alloy of the present invention has a feature that it contains Mo and Ni and/or Cu, and it is subjected to liquid-phase sintering, resulting in that the substrate structure is strengthened and therefore members made of the alloy can be used under severe conditions, e.g, at high planar pressures with exhibiting excellent abrasion resistance.

The present invention will be explained in greater detail with reference to Example hereinbelow.

EXAMPLE

The slidable member of the present invention was built as a slidable member of a rocker arm and tested on a table by using an internal combustion engine.

Powders of raw materials were compounded according to the formulations shown in Table 1. Each of the mixtures was molded at a pressure of 5 tons/cm$^2$, and sintered for 45 minutes in decomposed ammonia gas. Thus, slidable member No. 1 of the present invention and slidable member No. 2 of Comparison were obtained.

TABLE 1

| Sample No. | Composition (% by weight) C | P | Ni | Mo | Cr | Nb | Ti | B | V | Fe | Porosity % | % Pore Size of 150 μm or less | Final Substrate Structure |
|---|---|---|---|---|---|---|---|---|---|---|---|---|---|
| 1 (invention) | 2.5 | 0.5 | 0.7 | 1.0 | 7.3 | 5.0 | — | — | — | Balance | 4.0 | 90 | Bainite |
| 2 (comparison) | 2.5 | 0.5 | 1.0 | 10.0 | 10.0 | — | — | — | — | ditto | 6.0 | 60 | Bainite |

Engine Test (1) Operating Conditions

Engine tested: Water-cooled series 4-cylinder O.H.C.

Engine speed: 750 rpm, no load

Lubricating oil: SAE 30#
Oil temperature: 50° C.
Operating time: 200 hr (2) Cam shaft:

The material of the cam portion of the cam shaft was perlite which was a chilled cast iron containing 30 to 40% of carbide. It had the following chemical composition

| Cam Shaft Tested | Composition (% by weight) | | | | | | | | |
|---|---|---|---|---|---|---|---|---|---|
| | C | Si | Mn | P | S | Cu | Cr | Mo | Fe |
| Chilled cast iron | 3.4 | 2.1 | 0.7 | 0.1 | 0.04 | 0.3 | 0.8 | 0.3 | Balance |

The test results are shown in FIG. 1. In FIG. 1, the hatched portions show the amount of wear of the cam, and the non-hatched portions, the amount of wear of the rocker arm.

Thus, the slidable member made of the alloy composition of the present invention has a uniformly distributed hardened phase of fine particles of carbide precipitated by the addition of Nb, and exhibits excellent abrasion resistance by synergistic effect ascribable to the Nb containing carbide and large as well as fine Cr containing carbides.

Figure 2:
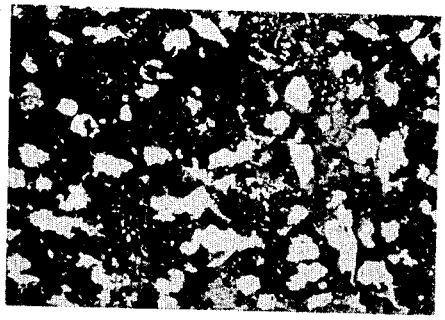
FIG. 2 is a microphotograph of the structure in the example of the slidable member of the invention.

FIG. 2 is a microphotograph (400×, etched) of the structure of the slidable member No. 1 of the invention. The large white phase consists of Fe-Cr carbide and steadite, and the fine white phase consists of Nb-Cr carbide and the substrate around the white phase is bainite.

While the invention has been described in detail and with reference to specific embodiments thereof, it will be apparent to one skilled in the art that various changes and modifications can be made therein without departing from the spirit and scope thereof.

What is claimed is:

1. An abrasion resistant sintered alloy for use in internal combustion engines which comprises 0.5 to 4.0% by weight of carbon, 5.0 to 30.0% by weight of Cr, 1.5 to 16.0% by weight of Nb, 0.1 to 4.0% by weight of Mo, 0.1 to 10.0% by weight of Ni and 0.1 to 5.0% by weight of P which permits liquid-phase sintering at temperatures not higher than 1,250° C., and the balance Fe and have 0.2 to 10% by volume of sintering pores at least 40% of which consist of pores having a pore size of not larger than 150 μm.

2. The abrasion resistant sintered alloy according to claim 1, wherein said alloy comprises 5.0 to 20.0% by weight of Cr, 3.0 to 12.0% by weight of Nb, 0.4 to 3.0% by weight of Mo, 0.1 to 5.0% by weight of Ni, and 0.2 to 3.0% by weight of P.

3. The abrasion resistant sintered alloy according to claim 2, wherein said alloy comprises less than 1.5% by weight of Si, and less than 1.0% by weight of Mn.

4. The abrasion resistant sintered alloy according to claim 3, wherein said alloy further comprises 0.1 to 10.0% by weight of Ti and/or V and 0.1 to 5.0% by weight of Cu and/or Co.

* * * * *